US005695094A

United States Patent [19]

Burnham et al.

[11] Patent Number: 5,695,094

[45] Date of Patent: *Dec. 9, 1997

[54] CABINET AND SUPPORTING FRAME FOR LIQUID DISPENSING SYSTEM WITH REMOVABLE RESERVOIR AND HOT TANK

[75] Inventors: Lowell C. Burnham, Freeport; Robin R. Saar, Shannon, both of Ill.; Knute Alstad, Sun Prairie; David W. Wendt, Monona, both of Wis.; Edward H. Donselman, Freeport, Ill.

[73] Assignee: Elkay Manufacturing Company, Oak Brook, Ill.

[ * ] Notice: The term of this patent shall not extend beyond the expiration date of Pat. No. 5,493,873.

[21] Appl. No.: 472,814

[22] Filed: Jun. 7, 1995

Related U.S. Application Data

[63] Continuation-in-part of Ser. No. 139,414, Oct. 20, 1993, Pat. No. 5,493,873, and Ser. No. 139,469, Oct. 20, 1993, Pat. No. 5,553,935.

[51] Int. Cl.[6] ..... B67D 5/62

[52] U.S. Cl. ..... 222/146.1; 222/146.5; 222/146.6; 222/609; 312/264

[58] Field of Search ..... 222/609, 146.1, 222/146.5, 146.6, 185; 62/389, 390, 394, 395; 312/264

[56] References Cited

U.S. PATENT DOCUMENTS

| | | | |
|---|---|---|---|
| 1,976,007 | 10/1934 | Cullen et al. . | |
| 2,192,862 | 3/1940 | Eagley | 222/609 X |
| 3,195,779 | 7/1965 | Nico | 222/146.6 X |
| 3,445,039 | 5/1969 | Brodsky et al. | 222/146.1 X |
| 3,843,021 | 10/1974 | Schieser . | |
| 3,856,374 | 12/1974 | Christen . | |
| 4,199,204 | 4/1980 | Hodsdon et al. . | |
| 4,391,308 | 7/1983 | Steiner . | |
| 4,497,524 | 2/1985 | Levings, Jr. et al. . | |
| 4,629,096 | 12/1986 | Schroer et al. . | |
| 4,712,844 | 12/1987 | Fry . | |
| 4,779,426 | 10/1988 | Desrosiers . | |
| 4,782,972 | 11/1988 | Wenkman et al. . | |
| 4,830,223 | 5/1989 | Priest | 222/146.6 |
| 4,834,267 | 5/1989 | Schroer et al. . | |
| 4,902,320 | 2/1990 | Schroer et al. . | |
| 4,991,635 | 2/1991 | Ulm . | |
| 5,222,530 | 6/1993 | Baker et al. . | |
| 5,222,531 | 6/1993 | Baker et al. . | |
| 5,246,141 | 9/1993 | Burrows | 222/146.6 X |
| 5,360,263 | 11/1994 | Nakano et al. . | |
| 5,493,873 | 2/1996 | Donselman et al. | 222/146.1 X |
| 5,553,935 | 9/1996 | Burnham et al. | 62/389 X |

FOREIGN PATENT DOCUMENTS

| | | |
|---|---|---|
| 0642359 | 6/1962 | Canada . |
| 2323308 | 11/1973 | Germany . |

*Primary Examiner*—Andres Kashnikow
*Assistant Examiner*—Kenneth Bomberg
*Attorney, Agent, or Firm*—Leydig, Voit & Mayer, Ltd.

[57] ABSTRACT

A readily disassemblable cabinet for a liquid dispensing system includes a supporting frame assembly having a base plate and a shelf, and further includes readily removable front, rear, and side panels and a separately removable top support and top panel. Readily removable metal rods are provided to secure individual base, shelf and top support components to the frame assembly. Such rods permit the quick removal of the system components and thus facilitate routine maintenance of the liquid dispensing system while minimizing the number of tools required to service the unit. The upper surface of the shelf supports a readily removable reservoir and the underside of the shelf is formed with brackets for receiving cross pins which removably support a hot tank for pivotal and translational movement toward and away from a valved waterway suspended below the reservoir.

12 Claims, 7 Drawing Sheets

CABINET AND SUPPORTING FRAME FOR LIQUID DISPENSING SYSTEM WITH REMOVABLE RESERVOIR AND HOT TANK

This application is a continuation-in-part of prior-filed applications Ser. No. 08/139,414, now U.S. Pat. No. 5,493,873, for "Liquid Dispensing Device" and Ser. No. 08/139,469, now U.S. Pat. No. 5,553,935, for "Cabinet and Supporting Frame for Liquid Dispensing Device," both filed on Oct. 20, 1993, and assigned to the same assignee as the present application; both of said prior-filed applications being incorporated herein by reference.

FIELD OF THE INVENTION

The present invention relates generally to liquid dispensing systems, and more particularly to a cabinet and supporting frame structure for liquid dispensing systems designed to receive an inverted water bottle or other liquid container, or those designed for a pressurized water supply point-of-use applications.

BACKGROUND OF THE INVENTION

Conventional bottled water coolers and liquid dispensers normally have a primary reservoir which is designed to receive water from the inverted neck of a bottle. Water flows directly from the bottle or through an adapter into an open top reservoir until the water level closes the bottle neck or adapter. Typically, a refrigeration system cools the reservoir and the water contained therein. Water is dispensed by draining the reservoir, usually through a valved faucet or spigot. Some systems are also designed to supply water from the primary reservoir to a secondary tank that has a heating system which provides hot water.

Alternatively, water may be supplied to conventional coolers and dispensers by connecting the primary reservoir to a constant water source such as a water supply line, rather than adapting the reservoir to receive water from an inverted bottle. Such units are typically plumbed to accept pressurized city water and are often called "point-of-use" dispensers in the trade.

Such bottled water coolers and point-of-use dispensers typically have a cabinet comprising sheet metal panels which are secured together by metal screws or the like to a frame structure generally comprising upstanding open metal angle or channel members. The sheet metal components, when secured to the metal frame members, define a hollow, column-like structure or cabinet for supporting not only an inverted liquid container, but also the internal components of the cooler and dispenser. Such cabinets, although common, suffer a number of intrinsic limitations. Being metal, the panels, frame members and therefore the entire cooler and dispenser, tend to be heavy; and because the panels are secured together by fasteners such as screws or bolts, compatible tools are required to assemble and disassemble the cabinet for service and maintenance. Moreover, the internal components of the dispenser are generally secured to the frame members by metal screws or bolts, often making component removal for even routine maintenance both difficult and time consuming.

OBJECTS AND SUMMARY OF THE INVENTION

It is a primary object of the invention to provide a liquid dispensing system which is easy to maintain and which can be quickly and conveniently serviced with only a minimum number of readily available, conventional tools.

A related object of the invention is to provide a cabinet assembly for liquid dispensing systems which allows ready access to the internal components of the dispenser and which is lighter and more portable than conventional dispensing cabinets.

It is a more detailed object of the present invention to provide the cabinet of a liquid dispensing system with side panels which can be easily removed without requiring removal of the front or rear panels of the dispenser.

A still more detailed object of the invention is to provide a liquid dispensing system in which the side panels of the cabinet can be easily removed without also requiring the removal of the top panel, so that an inverted water bottle can remain in place during servicing. It is a similar object of the invention to provide a cabinet in which the top panel can be removed without requiring concurrent removal of either or both side panels.

An additional and further object of the invention is to provide a liquid dispensing cabinet and supporting frame assembly which allows for the complete removal of the waterways and reservoirs to permit easy cleaning and sanitization of these system components.

It is a more particular object of the invention to provide a cabinet for liquid dispensing systems in which the frame as well as the side panels can be constructed of plastic for lightness and portability, and which is also inherently strong and durable.

The foregoing objects are accomplished in accordance with the present invention which provides a light weight and readily disassemblable cabinet for a liquid dispensing system supplied with drinking water or other potable liquid either from a liquid supply line plumbed into the system or from an inverted container having a depending neck dischargeable into a reservoir open at its upper end and housed within the dispensing cabinet.

In keeping with the invention, a dispensing cabinet and supporting frame assembly is provided with readily removable front, rear, and side panels, and a separately removable top support and top panel. The exterior panel components, as well as a base, shelf, top support and frame assembly are preferably formed of plastic so that the cabinet is light and easily portable. Being made of plastic, the cabinet can be styled to have smooth, clean lines, and the individual panel components can be molded in various colors and textures. Readily removable metal rods are provided in lieu of conventional fasteners to secure individual base, shelf and top support components to the frame assembly. Such rods permit the quick removal of the system components and thus facilitate routine maintenance of the liquid dispensing system while minimizing the number of tools required to service the unit.

These and other features and advantages of the invention will be more readily apparent upon reading the following description of a preferred exemplified embodiment and upon reference to the accompanying drawings, wherein:

Figure 1:
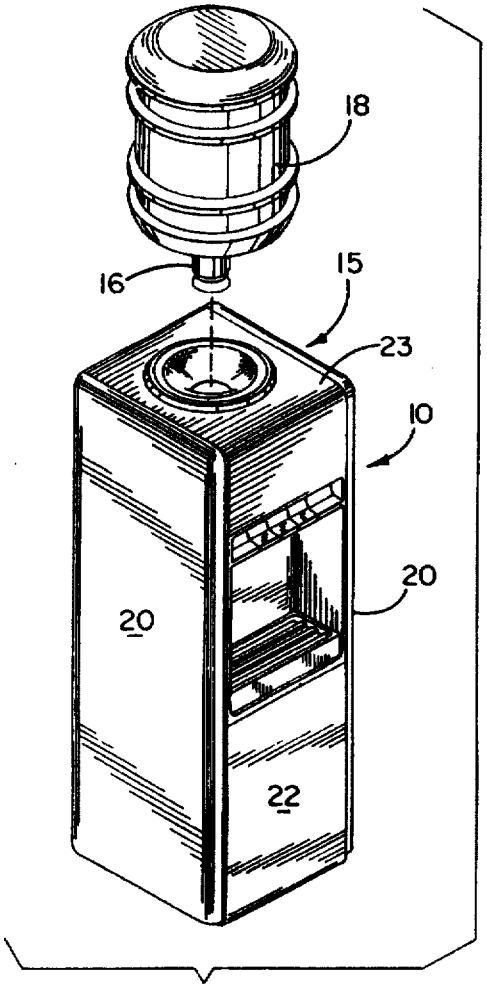
FIG. 1 is an isometric view of a liquid dispensing system cabinet of the present invention, with an inverted liquid container shown located above the dispenser rather than in a lower supported position to discharge its contents into the dispensing system housed within the cabinet.

While the invention will be described in connection with certain preferred embodiments, it is not intended to limit the invention to those specific embodiments. Rather, it is intended to cover all such alternatives, modifications, and equivalents as fall within the spirit and scope of the invention as defined by the appended claims.

DESCRIPTION OF THE PREFERRED EMBODIMENT

Turning now to the drawings, there is shown in greater detail a liquid dispensing system (shown generally as 10) including a cabinet (shown generally as 15) of the type having an open-topped primary cooling reservoir which is disposed to receive water from the inverted neck 16 of a bottle 18 containing drinking water or other potable liquid. In keeping with an aspect of the present invention, the cabinet has readily removable side and front panel components (20 and 22, respectively) and can be fitted with a top panel 23 which can also be readily removed, independent of the side panels, and changed to suit various dispensing applications. Typically, the reservoir and its contents are subject to temperature control by a refrigeration system and/or a heating system which, as described in greater detail below, is contained in the lower portion of the cabinet 15. Hot, cold and ambient temperature water may be obtained from the dispenser faucets by depressing the appropriate one of a plurality of valve operating levers projecting outwardly from the front panel 22 of the cabinet. In the illustrated cooler, the front panel has a recessed portion within which the faucet levers are mounted so as to set the faucets back into the cabinet and thus prevent inadvertent contact.

Figure 2:
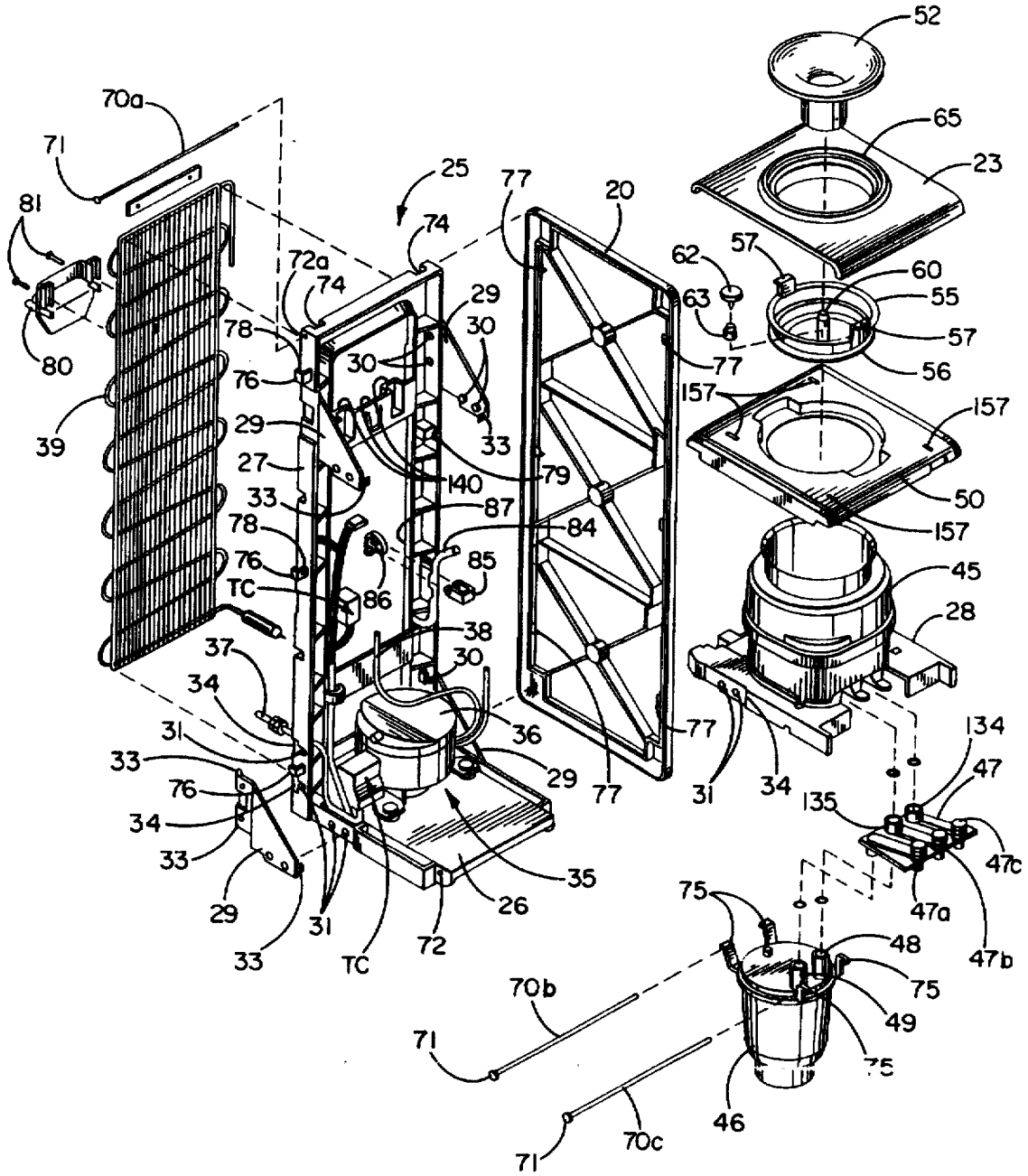
FIG. 2 is an exploded isometric view of the dispensing system of this invention, showing the frame assembly, side and top panels and the principal internal dispensing system components.

In keeping with the invention, and as best shown in FIG. 2, the cabinet 15 is comprised of a supporting frame assembly (shown generally as 25), which as illustrated is made up of a baseplate 26, an upstanding frame component 27, and a shelf 28. The baseplate and shelf are each connected and secured in cantilever fashion to the upstanding frame component by dovetailed connections and are reinforced by side-mounted gusset plates 29 that serve to interconnect and align the baseplate and shelf with respect to the upstanding frame component. The gusset plates also serve to strengthen the joint between the baseplate and the shelf on the one hand and the upstanding frame component on the other, and to this end, a plurality of projections or bosses 30 are provided on the interior surface of each gusset plate and are received in openings 31 on the sides of the baseplate and shelf components such that forces can be effectively transmitted therebetween. The gusset plates are provided with three additional tab projections 33 which are snap-fit into openings 34 in the baseplate, shelf and frame, and which serve to hold the gusset plates to the frame components with the bosses 30 engaged in the openings 31.

As illustrated in FIG. 2, the preferred dispensing system of the present invention includes a refrigeration system, designated generally as 35, comprising conventional components such as a compressor, condenser and evaporator coils. A thermostat, relay and electrical cables (designated generally as TC) are located, preferably, within a lower portion of the cabinet. The compressor 36 is powered by electricity received through a cord 37 from an external electric power outlet (not shown). The compressor compresses and circulates a refrigerant, such as HCFC 134a, through a line 38 to a condenser unit 39, which is attached by suitable connectors such as screws to the rear of the upstanding frame component 27. The condenser unit condenses the hot gas received from the compressor, and the condensed refrigerant is then circulated to an evaporator 40 (shown in FIG. 4), where the refrigerant evaporates, cooling the adjacent surface of the water reservoir. From the evaporator, the refrigerant is returned to the compressor via a supply line.

In keeping with the invention, the frame structure 25 supports the refrigeration system 35, as described above, the reservoir 45, a hot tank 46, the dispensing valve assembly 47 and the side, front, and top panel components 20, 22 and 23. The reservoir is supported by and rests on the shelf 28, and will be described in greater detail hereinbelow with reference to FIG. 4. As will be understood from the exploded view in the lower right side of FIG. 2, the hot tank 46 is suspended from shelf 28 and has an inlet 48 and an outlet 49, the latter of which communicates with the hot valve **47*a* of the valve assembly 47**.

A top support 50 overlies the reservoir 45 and has an opening which is coextensive with the open top of the reservoir. A hygienic liquid dispensing system may be utilized with the dispenser of the present invention, and as shown in FIG. 2 comprises a downwardly and inwardly tapered entry portion 52 nested in a cup-shaped support structure 56. The support structure includes a pair of diametrically opposed mounting arms 57 which engage the top support 50 and suspend the cup structure therefrom. An annular diaphragm-gasket 55 surrounds the cup-shaped structure and sealingly closes the open upper portion of the reservoir. Centrally located in the cup structure is an upstanding, hollow feed tube 60, whose operation is described in greater detail in U.S. Pat. No. 5,222,531, assigned to Elkay Manufacturing Company of Oak Brook, Ill. An air filter may be provided with a filter element 62 having a filter medium removably fitted on the housing of the filter. A conduit 63 is connected to the filter housing and passes via a grommet through the cup-shaped structure so that air cannot enter the reservoir except by passing through the filter medium.

Figure 12:
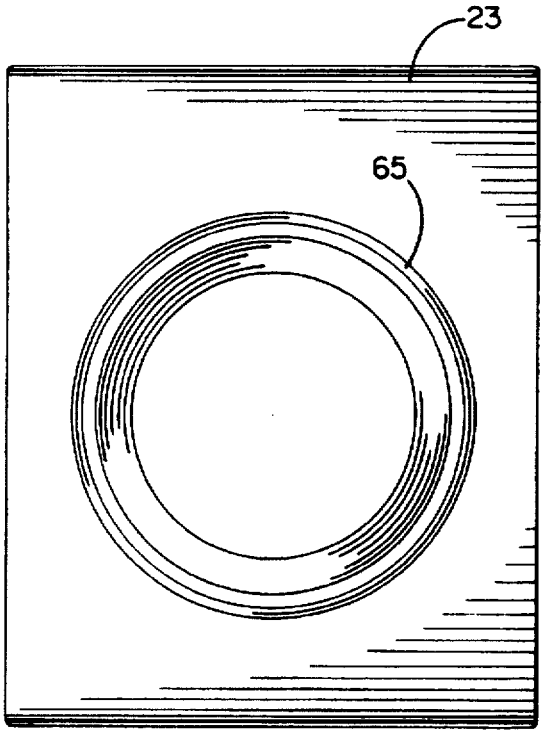
FIG. 12 is a plan view of the top panel of the dispenser of the present invention.
Figure 14:
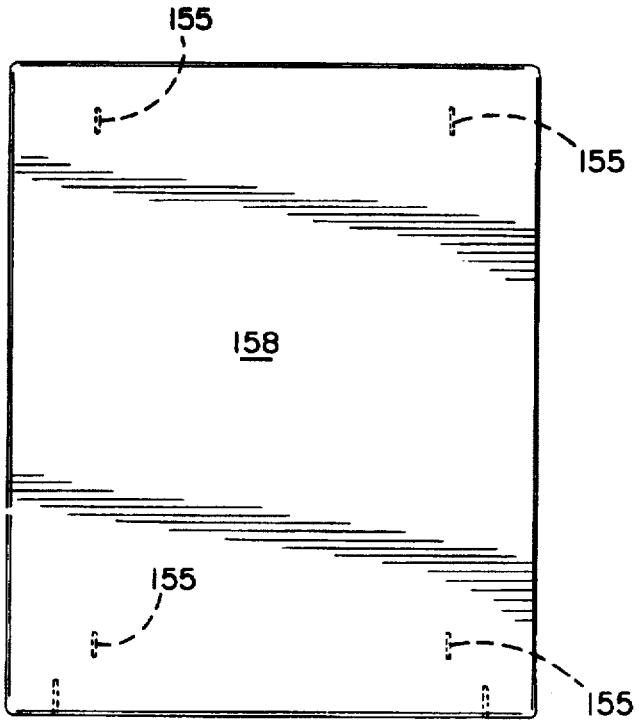
FIG. 14 is a plan view of a preferred alternative embodiment of the top panel of the present invention especially adapted for point-of-use applications.

It is a preferred feature of the present invention, and as illustrated in FIGS. 2, 12 and 14, that the top support 50 is designed to be covered by a top panel 23 which, as illustrated in FIG. 2, has an annular mounting ring 65 which is provided with a ledge to support the tapered entry member 52 extending downwardly and inwardly from the annular ring on the upper portion of the top panel 23. The entry member 52 is formed with a lower end having a length greater than the neck of the bottle 18 so that substantially all of the weight of the inverted bottle is supported by the annular ring 65 on the presented surface of the top panel.

Pursuant to an important feature of the invention, elongated metal rods 70, preferably all of uniform length to be interchangeable, and each with a head portion 71 on one end, are provided to secure selected components of and within the cabinet to one another. As shown most clearly in FIG. 2, one rod 70*a* is provided to interconnect the top support 50 to the upstanding frame component 27. The frame component 27 has, on its upper end, a pair of aligned holes 72*a* through which rod 70*a* can be inserted; a second pair of aligned openings is formed in two pivot lugs (not shown) which depend from the underside of the top support 50 and are molded integrally therewith. The pivot lugs are dimensioned to loosely fit within notches 74 formed in the top of the frame component 27, so that when the top support is placed in position on the frame component, the rod 70*a* can pass through the aligned holes of the frame component and the pivot lugs of the top support, thereby capturing the top support and pivotally securing it to the frame component.

Figure 7:
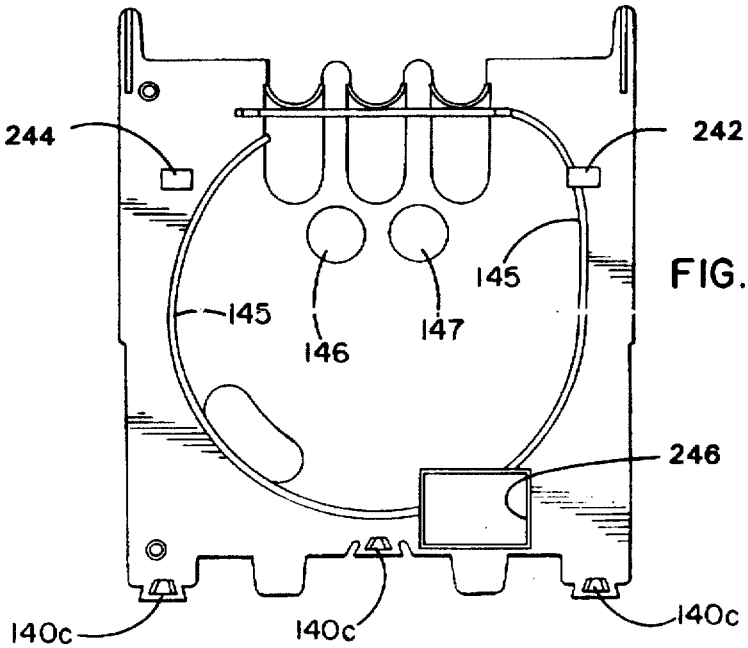
FIG. 7 is a plan view of the top surface of the shelf component of the frame assembly of the present invention.

Similarly, and in order to removably connect the hot tank 46 to the underside of shelf 28, a pair of laterally-aligned, downwardly projecting mounting lugs 242, 244 and a stirrup-like bracket 246 (as shown in FIG. 7) are provided on the underside of shelf 28. As shown in FIG. 2, the hot tank 46 has two pairs of aligned complemental ears 75, and each ear and each mounting lug has an opening formed therethrough such that a respective one of the rods 70*b* and 70*c* can be inserted through one pair of the mounting lugs associated with the underside of the shelf and the complemental pair of ears associated with the hot tank. In this way, and as will be described in greater detail hereinafter in connection with FIGS. 16 and 17, only two rods 70*b* and 70*c* are necessary to hold the hot tank in position under the primary water reservoir 45.

Figure 3:
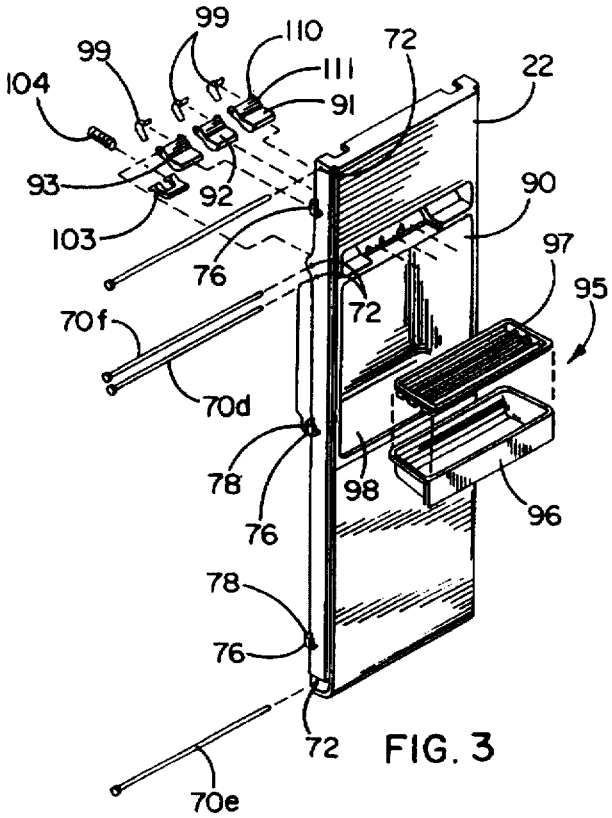
FIG. 3 is an exploded isometric view of the front panel of the dispenser of the present invention.

In keeping with another important aspect of the invention, the side panels 20 are also readily removable and are hung in position by lugs 76 provided on both the upstanding frame component 27 and the peripheral edge of the front panel 22 (as shown in FIG. 3). To facilitate the quick release of the side panels from the cabinet, a plurality of bayonet-type tab fittings 77 are provided on the inside surface of each side panel for engagement with recesses 78 formed in the complementary lugs 76 on the frame component 27 and the front panel 22. It will be understood, of course, that other suitable fastening means may be provided to allow the quick removal of the side panels from the frame assembly to provide ready access to the interior of the cabinet of the liquid dispensing system. Also as shown in FIG. 2, a single screw placed in recess 79 in frame component 27 can be utilized to lock projecting tab 79*a* on each side panel to the frame assembly so that only a standard tool, such as a screw driver, is necessary to remove the side panels from the cabinet.

Two subsidiary features are also shown clearly in FIG. 2. Consistent with the objective of providing a portable liquid dispensing system, a handle 80 is provided and secured into position at the rear of the cabinet by two screws 81 which cooperate with standard metal bifold fittings to secure the handle to the upstanding frame component 27 and shelf 28. Moreover, and consistent with the objective of providing a dispensing system which can be easily maintained, a drain closure is provided on the flexible plastic line 84 of the hot tank drain. The closure includes a U-shaped stirrup 85 which is connected to a manually rotatable camming element 86 which fits within a recess 87 formed integrally within frame component 27. As the camming element 86 rotates in one direction within the recess 87, the stirrup 85 is drawn towards the frame component 27, thereby crimping and closing the plastic line 84 of the hot tank drain without abrading its surface. Once closed, the drain line can be opened by rotating the camming element 86 in the opposite direction.

Turning now to FIG. 3, a removable front panel 22 is provided with a recessed portion 90 within which the valved faucets and operating levers (as shown, one for chilled water 91, one for water at ambient room temperature 92, and one for hot water 93) are mounted so as to set the faucet nozzles back into the cabinet. The recessed portion further permits placement of a two piece drip tray 95 under the faucets, to catch and retain liquid that might drip from the faucets. The drip tray 95 shown in FIG. 3 includes a lower tray 96 and a covering grate 97 and is intended to be placed on a ledge 98 defined by the lower surface of the recessed portion.

The faucet levers disclosed in FIG. 3 are biased by springs 99 to coact with the valves in the waterway assembly 47 shown in FIG. 2. Thus each faucet lever 91, 92 and 93, when depressed, opens one of the valves 47*a*, 47*b* and 47*c* of the waterway assembly 47, permitting water to be drawn from one of the reservoirs 45, 46. To obtain cold water, the lever 91 is depressed and chilled water is drawn from the lower portion of the primary water reservoir 45 which is in thermal communication with the coils of the evaporator 40. To obtain "cooking water," the lever 92 for water at ambient temperature is depressed and water is drawn from the upper portion of the primary reservoir 45, which is defined by a baffle (designated by reference number 100 in FIG. 4) which bisects the primary reservoir into an upper portion and a lower portion for chilled water. If hot water is desired, the lever 93 for hot water is depressed and water is drawn from the hot tank 46.

In further keeping with the present invention, a child resistant lock 102 is provided with the hot water faucet lever 93 to prevent accidental discharge of the hot water tank. The lock 102 includes a push bar 103 which fits within and is retained by faucet lever 93. The push bar 103 is outwardly biased by spring 104, which urges the outward edge of push bar 103 through a slit 105 in faucet lever 93. The push bar 103 is in the locked position when biased outwardly so that rod 70*d* blocks the downward movement of faucet lever 93. When push bar 103 is pushed inwardly and faucet lever 93 is depressed simultaneously, the push bar is no longer blocked by rod 70*d*, and water can be drawn from the hot tank.

With reference again to FIG. 3, removable rods 70 are used to connect various dispenser components. Thus a rod 70*e* can be passed through aligned holes 72*e* at the foot of the front panel 22 and the front of the base plate 26 to secure those elements together. Similarly, a rod 70*f* is used to secure the faucet levers 91, 92 and 93 in the front panel, and to this end, each faucet lever has a pair of pivot lugs 110, each of which has an opening 111. Consistent with an important aspect of this invention, rod 70*f* can be inserted through these openings 111 to pin the levers into position on the presented face of the front panel 22. Likewise, a rod 70g at the top of the front panel 22 connects to the front of the top support 50 in the same way as the frame component 27 and the rear of the top support 50 are connected.

Also with respect to FIG. 3, three lugs 76 are shown on the peripheral edge of the front panel 22. Each lug 76 has a recess 78, as described above, for receiving a bayonet-type tab on the side panel, for attaching each side panel 20 to close the dispensing cabinet.

Figure 4:
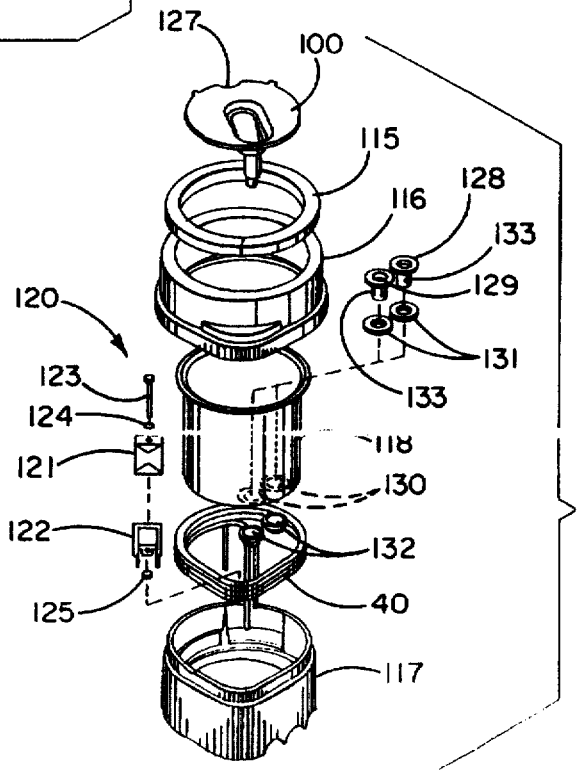
FIG. 4 is an exploded view of the primary reservoir and structure shown in assembled relation in FIG. 2.

An exploded view of the primary water reservoir 45 is shown in FIG. 4. As shown there, insulating components 115, 116 and 117 surround and insulate a stainless steel tank 118. The lower portion of the tank 118 is in close thermal communication with the coils of the evaporator 40, and is wedged into position by a camming block 120 having two wedge-shaped sections 121, 122 which can slide against each other to achieve a thicker or thinner composite, depending upon the disposition of one section relative the other. A set screw 123, washer 124 and nut 125 are provided and the set screw 123 can be tightened to hold the sections together in fixed relation.

Water enters the reservoir tank 118 from the open top and encounters a baffle 100 which, as described above, divides the tank into two portions. Water moves from the top portion above the baffle to the lower portion of the tank by flowing past the baffle via a notch 127. Water flows out of the reservoir via discharge fittings 128, 129, which are mounted in tank openings 130 by sealing washers 131 and lock nuts 132. The fittings 128, 129 are provided with short conduit sections 132 which are received respectively in fittings 134, 135 of valve assembly 47, which communicate with valves 47c and 47b, respectively, of valve assembly 47. Water is drawn from the reservoir at two points, from above and below baffle 100, such that chilled water is provided via fitting 128 to cold water valve 47c, and water at ambient temperature is provided via fitting 129 to valve 47b.

Figure 5:
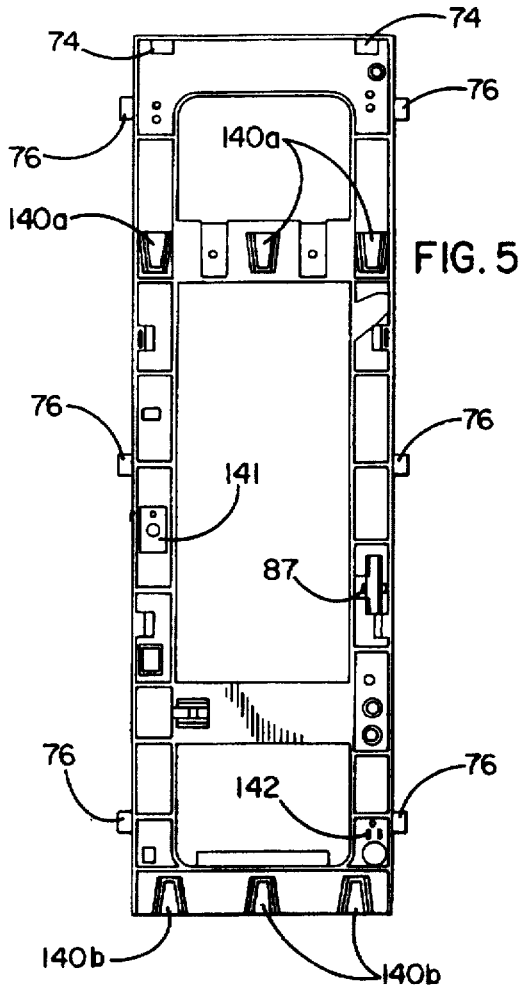
FIG. 5 is a front-inside elevation view of the upstanding frame component of the frame assembly of the present invention.
Figure 6:
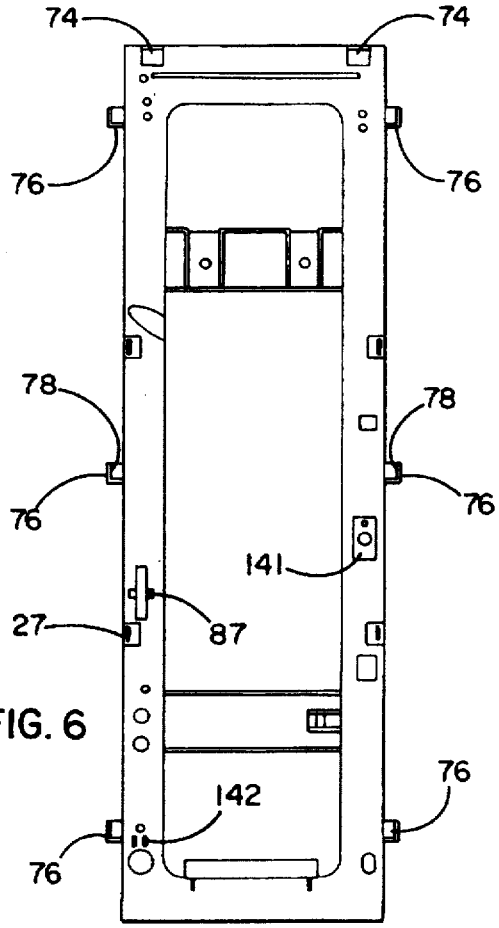
FIG. 6 is a rear-outside elevation view of the upstanding frame component shown in FIG. 5.

A preferred embodiment of the upstanding frame component 27 is shown in FIGS. 5 and 6. FIG. 5 is a front-inside elevation view and shows the lugs 76 which receive the tabs 77 on the side panels and the female portion of the dove-tailed fittings 140a and 140b which interconnect the shelf 28 and the base plate 26, respectively, to the frame 27. It will be noted that the dove-tailed fittings 140b are disposed in inverted relation. FIG. 6 also shows the lugs 76 and the recesses 78 therein. The recess 87 for the camming element 86 is also shown in these Figures. In accordance with an important feature of this invention, the frame assembly, including the upstanding frame component, the baseplate and the shelf are molded of a plastic such as a polycarbonate for lightness and strength. The use of plastics for these components also facilitates the formation of pass-through openings (such as at 141 for a switch and 142 for the prongs of a power plug, to hold the plug when transporting the dispensing unit), inasmuch as openings and channels can be formed when the plastic is molded.

The shelf 28 is shown more clearly in FIG. 7, and as illustrated here is provided with dove-tailed fittings 140c which fit tightly with fittings 140a on the upstanding frame component 27. An annular wall 145 serves to locate the reservoir 45 on the shelf so that fittings 128 and 129 on the bottom of the reservoir will communicate with the valve assembly 47 through openings 146 and 147 on shelf 28. FIG. 7 also shows the preferred embodiment for securing the hot tank 46 to the underside of the shelf. Thus, the shelf can be molded to include one pair of mounting lugs 242 and 244 on the underside of the shelf to receive a cross pin or rod 70c, and a curved hanger 246, also formed on the undersurface of the shelf, is open at the sides to accept a cross pin or rod 70b. As will be described in greater detail later in connection with FIGS. 16 and 17, the curved hanger is dimensioned to fit between one pair of ears 75 on hot tank 46, and the rod 70b can be inserted therethrough and through the aligned holes of the ears, thus suspending the hot tank in the curved hanger 246.

Figure 8:
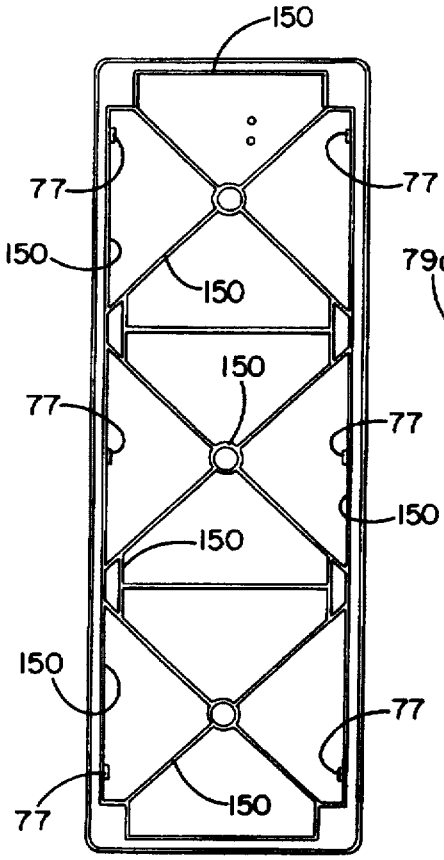
FIG. 8 is a front-inside elevation view of a side panel.
Figure 9:
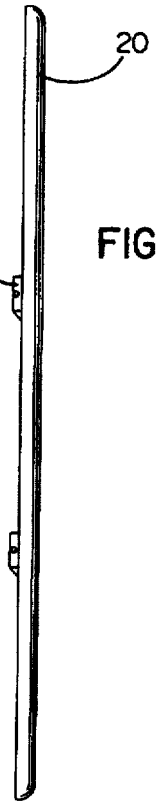
FIG. 9 is a side elevation of the side panel shown in FIG. 8.

FIGS. 8 and 9 show an exemplary side panel 20. The side panels are preferably made of a plastic such as polypropylene so that they can be molded, as shown in FIG. 8, to have cross-bracing 150 on their inside face for strength and rigidity. FIG. 8 also shows the bayonet-type tab fittings 77 which are employed to removably and interchangeably mount the side panels to either side of the dispensing cabinet 15. A projecting tab 79a is shown clearly in FIG. 9 and is provided to receive a screw placed in recess 79 in frame component 27 to lock the side panel to the frame assembly as previously described.

Figure 10:
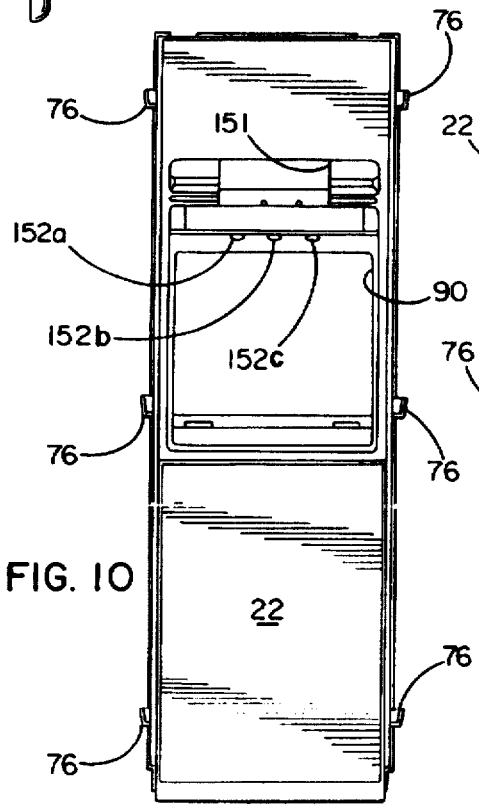
FIG. 10 is a front-outside elevation view of the front panel of the dispenser of the present invention.
Figure 11:
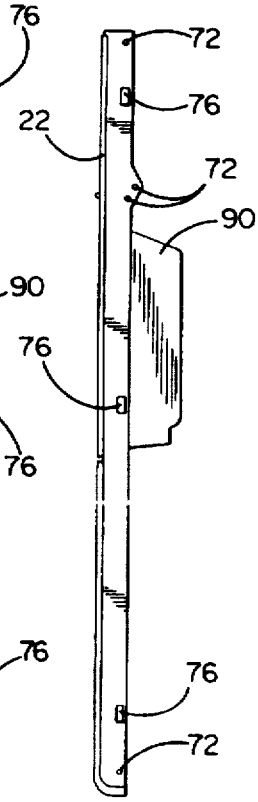
FIG. 11 is a side elevation of the front panel component shown in FIG. 10.

The preferred embodiment of the front panel is depicted in FIGS. 10 and 11, absent the drip tray 95. Six lugs 76 for mounting the side panels are shown on the periphery of the front panel, and holes 72 for receiving rods 70 are clearly shown in FIG. 11. An opening 151 for faucet levers 91, 92 and 93 is provided, as are openings 152a, 152b and 152c for receipt of valves 47a, 47b and 47c to facilitate the smooth discharge of water or other potable liquid. Like the side panels, the front panel is molded of polypropylene for lightness and durability.

Figure 13:
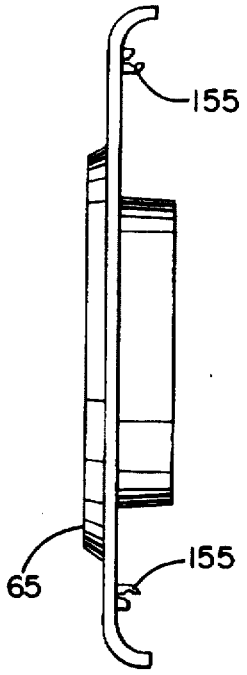
FIG. 13 is a side elevation view of the top panel shown in FIG. 12.

It is another preferred feature of the invention, and as illustrated in FIGS. 12 and 13, that the top panel 23 be provided with releasable clips 155 so that the top panel is removable from and replaceable on the cabinet assembly 15 when routine maintenance is performed. The releasable clips are received in recesses 157 in the top surface of top support 50, as best shown in FIG. 2. The top panel 23 is preferably molded of polypropylene, but those skilled in the art will appreciate that other suitable materials are available to achieve the desired properties of durability, strength and low weight.

Figure 15:
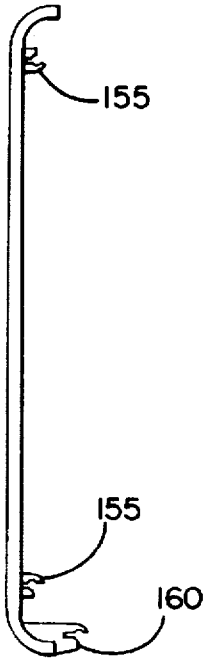
FIG. 15 is a side elevation view of the top panel shown in FIG. 14.

An alternate embodiment of a top panel useful for point-of-use applications is depicted in FIGS. 14 and 15, wherein a top panel 158 is shown with a flush upper surface, covering and closing the top of the cabinet 15 of the liquid dispensing system. Like the top panel shown in FIGS. 12 and 13, releasable clips are provided to locate and releasably secure the flush panel 158 to the top support 50. In addition, pivot brackets 160 may be provided on one edge of the panel 158 and are positioned to be engaged when the rod 70a is inserted through notches 74 at the top of upstanding frame component 27. When the brackets 160 are so captured by rod 70a, the top panel 158 is then pivotable about rod 70a and may be lifted by its front edge to expose the top support 50 and the primary reservoir 45.

Figure 16:
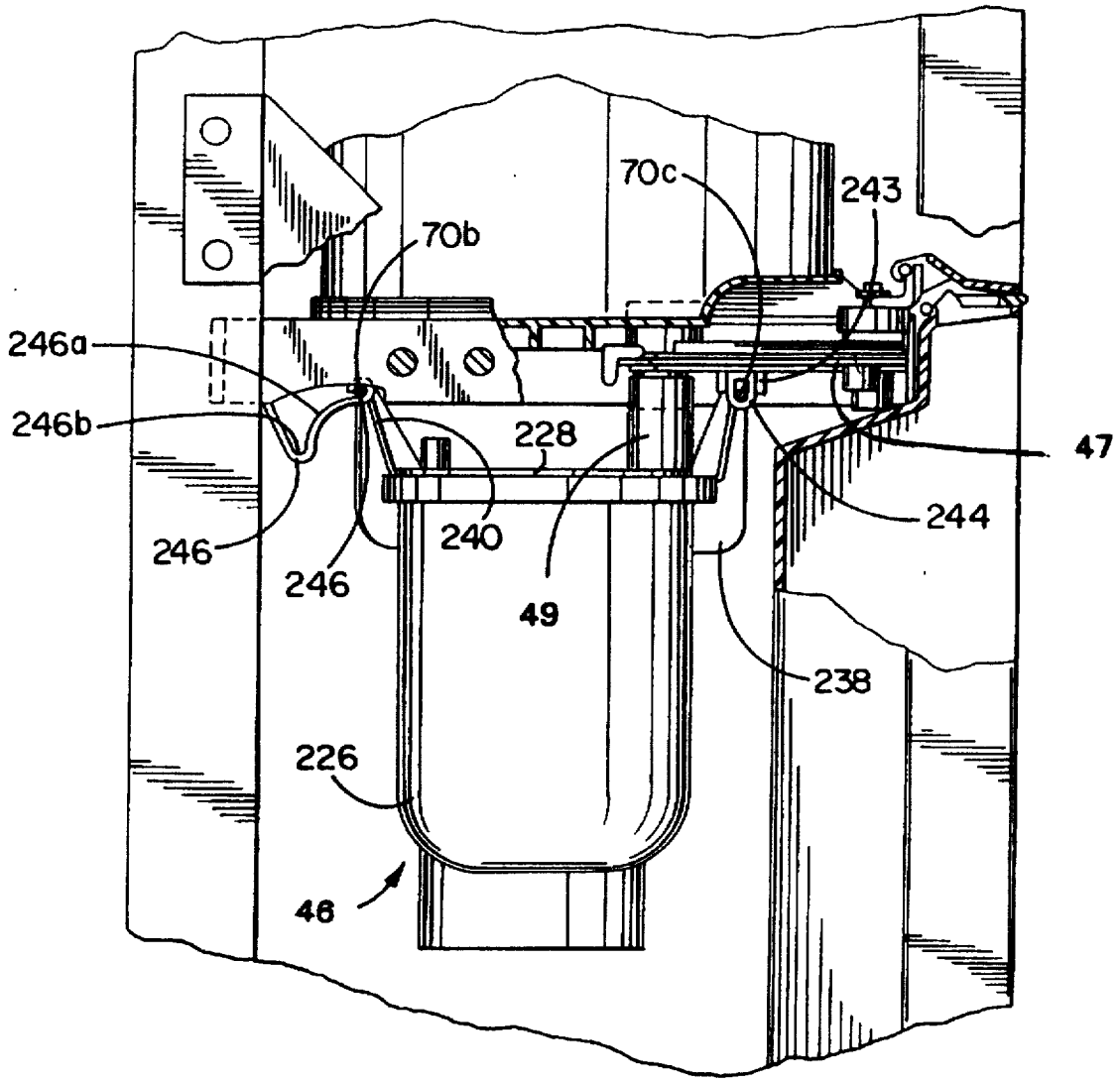
FIG. 16 is an enlarged side view, with portions broken away and in section, of the hot tank positioned for use within the cooler.
Figure 17:
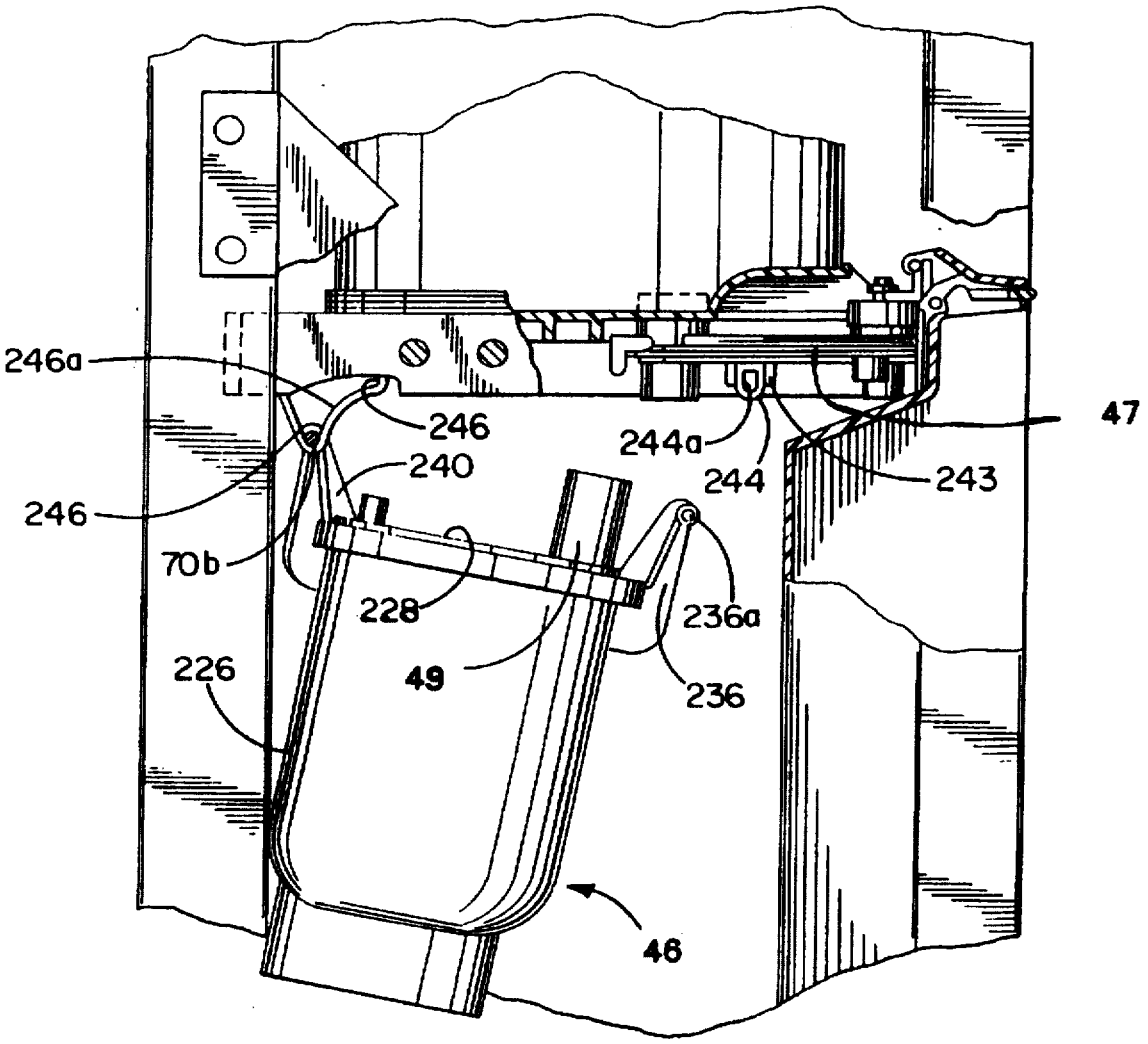
FIG. 17 is an enlarged side view, similar to FIG. 16, of the hot tank partially disassembled from the cooler.

Returning now to FIGS. 16 and 17 and the preferred mounting and structure of the hot tank 46 in accordance with the objects of the invention, the hot tank 46 is completely removable from the water cooler 10, and may be disassembled for cleaning or replacement. As shown in FIGS. 2, 16 and 17, the hot tank 46 includes an open top tank 226, and a cover 228, each having a series of connecting elements, which engage along their mating surfaces. In this way, the open top tank 226 and cover 228 may be separated to facilitate easy and thorough cleaning.

Preferably, the hot tank inlet and outlet tubes 48, 49 extend through and are formed integrally with the cover 228.

However, the tubes could be separately formed and secured and sealed to the cover 228. A heating coil and a heat thermostat (not shown) are preferably located in the lower portion of the hot tank 46, and the hot tank inlet tube 48 extends down to the bottom portion of the hot tank 46. In this way the lower temperature water is heated, and then rises to the top. The hot tank outlet tube 49 extends from the upper portion of the hot tank cover 228, to drain the hottest water from the hot tank 46.

As shown in FIG. 16, the hot tank 46 is held in position in the water cooler 10 by two rods 70*b*, 70*c*, which provide hinge type assemblies that may be disassembled to permit removal of the hot tank 46. Disposed along the top 228 of the tank 46 are spaced ears or arms (shown generally as 75 in FIG. 2 and as 234, 236, 238, 240 in FIGS. 16 and 17) which define through holes 234*a*, 238*a* 240*a*. In the preferred embodiment of the invention, the arms are each formed from a pair of arm components which are curved in opposite directions to form the through holes.

The shelf 28 of the water cooler 10 is similarly provided with lugs or support brackets 242, 244, 246 and spacers 243, 245 which extend downward from the lower surface of the shelf 28. Support brackets 242, 244 define through holes 242*a*, 244*a*. Support bracket 246 defines a "slotted" opening 246*a* having two seats 246*b*, 246*c*. The hinge assemblies further include two rods 70*c*, 70*b* which extend through the through holes 234*a*, 236*a*, 238*a*, 240*a*, 242*a*, 244*a*, and slotted opening 246*a* to suspend the hot tank 46 within the water cooler 10. It will be noted that the spacers 243, 245 are disposed adjacent the rod 70*c* to stabilize the rod 70*c* and the hot tank 46 in position.

As shown in FIG. 16, when the hot tank 220 is in operational position within the water cooler 10, rod 70*c* is disposed within through holes 234*a*, 236*a*, 242*a*, 244*a*; rod 70*b* is disposed within through holes 238*a*, 240*a* and opening 246*a*, seated at seat 246*b*. In order to remove the hot tank 46 from the water cooler 10, rod 70*c* is removed from the through holes 234*a*, 236*a*, 242*a*, 244*a*. Once rod 70*c* is removed, rod 70*b* is free to move downward in the slotted opening 246*a* to seat 246*b* to pivot and move the hot tank 46 downward within the water cooler 10, and rearwardly away from the valve waterway assembly 47, as is shown in FIG. 17. Rod 70*b* may then be removed from through holes 238*a*, 240*a* and opening 246*a* to completely remove the hot tank 46 from the water cooler 10. The hot tank 46 may be reassembled within the cooler 10 in a similar manner.

From the foregoing description and in keeping with the present invention, it will be understood that the top panel 23 of the cabinet assembly can be removed without removing the side or front panels; and similarly, the side panels can be removed, permitting access to the interior of the cabinet, without removing the top or front panels. Moreover, service and maintenance of the cabinet assembly and the other components of the liquid dispensing system is facilitated by the use of removable rods 70 to pin selected components in position on a light-weight plastic frame assembly. It will also be understood that any allowed claims based on this application are to be accorded a range of equivalents commensurate in scope with the advance over the prior art.

We claim as our invention:

1. A liquid dispensing device including a cabinet housing a liquid reservoir and valve means for dispensing liquid from the reservoir, said cabinet comprising, in combination, a base, a top support, a back member having lower and upper ends, and a front panel having lower and upper ends, means for securing the base and top support to the lower and upper ends, respectively, of the back member and the front panel to form a substantially rigid, open sided, rectangular structure, wherein the means for securing the base to the lower end of the front panel and the means for securing the top support to the upper ends of the back member and the front panel each includes a slidably removable cross pin dimensioned for insertion in openings formed at the respective corners of said rectangular structure, said back member and said front panel each having side edges and first connecting means disposed on said side edges, at least one side panel having second connecting means disposed and dimensioned for cooperation with said first connecting means for detachably connecting said side panel to said structure to close at least one of said open sides, and means within said cabinet for removably supporting said reservoir.

2. A liquid dispensing device as defined in claim 1 wherein the means for removably supporting said reservoir includes an intermediate support shelf molded of plastic material, and means for securing the support shelf to the back member.

3. A liquid dispensing device as defined in claim 2 including a plurality of interfitting dovetail elements molded respectively into the plastic material of the shelf and the back member.

4. A liquid dispensing device as defined in claim 3 wherein the means for securing the shelf to the back member includes a pair of opposite-side gussets having snap-fitting connector elements, and the side edges of the shelf and the back member are formed with means for receiving said snap-fitting connector elements.

5. A liquid dispensing device as defined in claim 3 including means for securing the shelf to the front panel including a slidably removable cross pin dimensioned for insertion in openings formed in the shelf and the front panel.

6. A liquid dispensing device as defined in claim 2 wherein said reservoir is removably mounted on and supported by the upper surface of said shelf and said reservoir includes a plurality of outlet fittings and said valve means includes a plurality of inlet coupling portions dimensioned for slidably receiving and sealingly engaging said respective reservoir outlet fittings in press-fit connecting relation.

7. A liquid dispensing device as defined in claim 6 including a removable hot tank disposed below said reservoir, said shelf and said valve means, said hot tank having inlet and outlet fittings at the top thereof, and said valve means including cooperating coupling portions dimensioned for slidably receiving and sealingly engaging said inlet and outlet fittings of said hot tank in press-fit connecting relation.

8. A liquid dispensing device as defined in claim 7 including means for pivotally mounting said hot tank in said cabinet so that said inlet and outlet fittings of said hot tank may be selectively swung into and out of sealing engagement with said cooperating coupling portions of said valve means.

9. A liquid dispensing device as defined in claim 8 wherein said pivotal mounting means for said hot tank also defines means for permitting limited translational movement of said hot tank toward and away from said valve means in order to facilitate removal of said valve means when said hot tank is pivoted down and moved away from said valve means.

10. A liquid dispensing device as defined in claim 7 wherein said hot tank includes mounting arms and including means for removably mounting said hot tank on said shelf below said reservoir and said valve means, said removable mounting means including at least one slidably removable cross pin dimensioned for insertion in openings formed in said shelf and said hot tank mounting arms.

11. A liquid dispensing device as defined in claim 10 including a plurality of slidably removable cross pins, one of said cross pins forming a pivotal mounting for swinging said hot tank toward and away from said valve means and another of said cross pins being operative to hold said hot tank with said inlet and outlet fittings in engagement with said cooperating coupling portions of said valve means.

12. A liquid dispensing device as defined in claim 11 wherein said shelf is provided with means for permitting translational movement as well as pivotal movement of said one cross pin to permit said hot tank to be pivoted down and moved away from said valve means.

* * * * *